US006877876B1

(12) United States Patent
Steinhilber

(10) Patent No.: US 6,877,876 B1
(45) Date of Patent: Apr. 12, 2005

(54) VARIABLE BEAM ILLUMINATION DEVICE

(76) Inventor: Stephen C Steinhilber, 899 Rte. 17A, apt. 9, Greenwood Lake, NY (US) 10925

( * ) Notice: Subject to any disclaimer, the term of this patent is extended or adjusted under 35 U.S.C. 154(b) by 0 days.

(21) Appl. No.: 10/223,293

(22) Filed: Aug. 19, 2002

(51) Int. Cl.[7] ..... F21V 4/04
(52) U.S. Cl. ..... 362/188; 362/187; 362/205
(58) Field of Search ..... 362/188, 170, 362/174, 187, 198, 203, 205

(56) References Cited

U.S. PATENT DOCUMENTS 5,461,552 A * 10/1995 Tillery ..... 362/188

* cited by examiner

*Primary Examiner*—Stephen Husar
*Assistant Examiner*—Guiyoung Lee
(74) *Attorney, Agent, or Firm*—Michael I Kroll

(57) ABSTRACT

A variable beam flashlight has a housing with an exterior control knob that is movable by thumb. A light assembly in the housing includes a casing having a cylindrical guide housing within a bore, the inner surface defining the bore having a helical grove. Within the guide housing is cylindrical bulb extension member in which the bulb is fitted to one end. The bulb extension member has a groove member that extends through a slot in the guide housing and into the helical groove, such that when the control knob is rotated by the thumb, the guide housing is rotated. The rotating guide housing slot displaces the groove member causing the groove member to follow the helical groove. As it follows the groove the bulb extension member is moved longitudinally within the guide housing, causing the bulb to be positioned at variable distances from the front lens.

7 Claims, 12 Drawing Sheets

VARIABLE BEAM ILLUMINATION DEVICE

BACKGROUND OF THE INVENTION

1. Field of the Invention

The present invention relates generally to illumination devices and, more specifically, to illumination devices with variable beams.

2. Description of the Prior Art

There are other variable flash light beam devices designed for beam adjustment. Typical of these is U.S. Pat. No. 4,388,673 issued to Anthony Maglica on Jun. 14, 1983.

Another patent was issued to Fredrick J. Conforti. et al. on Nov. 8, 1983 as U.S. Pat. No. 4,414,612. Yet another U.S. Pat. No. 4,987,523 was issued to Bruce W. Landabury, et al. on Jan. 22, 1991 and still yet another was issued on Oct. 30, 1990 to Shoei-Shuh Shiau as U.S. Pat. No. 4,967,325.

Another patent was issued to John F. Denison, et al. on Sep. 28, 1993 as U.S. Pat. No. 5,249,109. Yet another U.S. Pat. No. Ricky W. Tillery on Oct. 24, 1995. Another was issued to James W. Gatton on on Aug. 6, 1985 as U.S. Pat. No. Des. 4,533,984 and still yet another was issued on Aug. 14, 1990 to Fu H. Wang as U.S. Pat. No. 4,949,231. Other patents were issued to Gary W. Kibler, et al. on Feb. 2, 1999, as U.S. Pat. No. 5,865,525, Shoei-Shuh Shiau on Apr. 04, 1997, as U. K. No. GB 2306000, Steven A. Griffiths on Jul. 16, 1997, as U.K. GB 2309073, and Gary W. Kibler on Oct. 27, 1998 as U.S. Pat. No. 5,826,971.

U.S. Pat. No. 4,388,673

Inventor: Anthony Maglica

Issued: Jun. 14, 1983

The flashlight of the invention includes an improved mechanism for selectively varying the light beam intensity and area. The mechanism includes a cam member, and abutting head and outer switch housing shoulders, which enable movement of the bulb forwardly and rearwardly relative to the light reflector by rotation of the head of the flashlight, so as to selectively vary the intensity and area of the light beam, while preventing axial movement of the head and light reflector. The flashlight includes structural means for recharging its battery; and a battery charger/flashlight holder is designed to retain the flashlight and charge the batteries when the flashlight is stored therein. A shield in the lens prevents damage from heat emitted by a high intensity halogen bulb.

U.S. Pat. No. 4,414,612

Inventor: Frederick J. Conforti, et al.

Issued: Nov. 8, 1983

A flashlight has a battery housing and a head. A carriage is slidably mounted on opposing walls of the head. The carriage carries a socket for holding a flashlight bulb. A tab on the carriage is accessible to one's finger to enable movement of the carriage and the bulb carried thereby in any one of a number of positions, thereby to control the beam width.

U.S. Pat. No. 4,987,523

Inventor: Bruce W. Landabury, et al.

Issued: Jan. 22, 1991

An illumination device, for example, a flashlight includes an adjustable beam focus assembly to change the relative position of the lamp bulb to the reflector to alternately provide a narrow focused or wide beam being emitted from the device. The adjustable beam focus assembly includes a resilient blade supporting the lamp bulb extending through an opening in a reflector of the device. Beam focusing is achieved by flexing the blade upon application of a displacing force to the base of the bulb by a cam or to the blade itself using a plunger.

U.S. Pat. No. 4,967,325

Inventor: Shoei-Shuh Shiau

Issued: Oct. 30, 1990

A flashlight includes a head assembly, a barrel, and a lamp base. The lamp base is fixed inside the head assembly and is rotatably engaged to the barrel. When the head assembly is rotated relative to the barrel, a flashlight bulb fixed to said lamp base moves axially away or towards a lens attached to the head assembly, thus varying the focusing distance of the bulb. The barrel serves as a contact between the negative terminal of the battery and a terminal end of the flashlight bulb. A second terminal end of the flashlight bulb is connected to an elastic spring whose base is fixed on a metal post. The rotation of the head assembly relative to the barrel can accordingly compress or expand the elastic spring. The elastic spring can thus urge the metal post to contact the positive terminal of the battery.

U.S. Pat. No. 5,249,109

Inventor: John F. Denison, et al.

Issued: Sep. 28, 1993

An adjustable outdoor light fixture powered by an electrical current provided by wire leads capable of producing variable light beam distribution pattern comprising, a housing having an outside surface and an inside surface and defining a cavity with an open face, a reflector supported with the cavity of the housing, a lens covering the open face of the housing, the lens movable relative to the reflector, and a light source connected to the leads adapted to be attached to the lens within the cavity of the housing whereby the lens and the light source are movable relative to the reflector in order to produce a variable light beam distribution pattern. Also included is a reflex optic reflector for an outdoor light fixture that improves transmittance of light from the fixture.

U.S. Pat. No. 5,461,552

Inventor: Ricky W. Tillery

Issued: Oct. 24, 1995

A miniature adjustable beam flashlight having a switch control nut that is rotatable in first and opposite directions around the body of the flashlight for controlling a switch assembly in order to energize a lightbulb and adjust the light beam produced thereby. The switch assembly is interconnected with the switch control nut so as to move in first and opposite longitudinally expending directions through the body of the flashlight to complete or open an electrical conduction path between a battery supply and the lightbulb when the nut is rotated in the first or opposite directions around the body. The lightbulb is coupled to the switch assembly and adapted to move therewith in the first and opposite longitudinally extending directions so that the lightbulb is axially advanced relative to the body when the electrical circuit path is opened or retracted when the circuit path is completed. All of the forgoing is accomplished without having to manipulate the head of the flashlight as is otherwise required to operate some conventional adjustable beam flashlights.

U.S. Pat. No. Des. 4,533,984

Inventor: James W. Gatton

Issued: Aug. 6, 1985

A variable-width-beam light apparatus is provided having a lamp and a reflector assembly in which a lamp is supported for selective axial displacement along a longitudinal optical axis with respect to a focal point of the reflector to enable adjustment in the width or angle of divergence of an emitted beam of light. The lamp is selectively positioned by a rotatable knob carried by a lens of the assembly and positioned exteriorly at the front of the lens for operation. The rotatable knob connects with a shaft coupled by screw threads with a lamp engaging cylinder that is axially sliceable in a tubular guide way such that rotational movement is translated to longitudinal movement to effect and control axial displacement of a lamp. The lamp is resiliently biased in a forward direction with respect to the lens. The lamp and reflector assembly is supported in a housing on journals permitting selective angular positioning of the assembly about an axis disposed transversely to the longitudinal optical axis of the reflector to direct the light beam in a selected direction with respect to the housing. A modification includes two lamps and reflector assemblies incorporated into a unitary structure and mounted for relative rotation in a housing about a single axis.

U.S. Pat. No. 4,949231

Inventor: Fu H. Wang

Issued: Aug. 14, 1990

A flashlight includes a tube; a control ferrule with an inner helical groove being rotatably disposed on the front portion of the tube; a face cap with a lens and a reflector being provided on the front end of the front portion; and one or more batteries being disposed within the tube. A socket with two conductors respectively connected to two prongs of a light bulb is slidably disposed within the front portion of the tube. A pin couples the socket to the control ferrule so that the socket is guided to move along the guide holes of the tube by the relative movement between the pin and the control ferrule. A sleeve is disposed on one end of a tail cap for engaging into a rear end of the tube. A small gap separates the sleeve and the tail cap. A spring member is disposed between the tail cap and the battery so as to urge the tail cap not to electrically connect to the tube. An intermittent gentle pressure on the tail cap causes the tail cap intermittently connected with the tube and produces an intermittent lighting of the lightbulb.

U.S. Pat. No. 5,865,525

Inventor: Gary W. Kibler, et al.

Issued: Feb. 2, 1999

A slide focus flashlight has a container with an aperture therein, a lamp disposed within the container, a reflector disposed within the container, and an actuator disposed in the opening of the container for sliding therein and having a first angled surface. A conductive shaft is disposed within the container, and a slide interface is coupled to the conductive shaft. The slide interface has a second angled surface for sliding against the first angled surface of the actuator. A power switch is provided for selectively energizing the lamp. The slide interface, actuator and power switch allow for single-handed focusing and energizing of the flashlight.

U.S. Pat. No. 5,865,971

Inventor: Gary W. Kibler

Issued: Oct. 27, 1998

A method and apparatus for selectively focusing a flashlight are provided. The apparatus includes a flashlight having a flashlight body with a cavity therein and further having an actuator-receiving opening through a portion of the flashlight body. A reflector for reflecting light and a lamp for producing light are disposed within the cavity. A housing assembly is disposed within the cavity and moveable therein. The housing assembly includes a housing. An actuator extends into the actuator-receiving opening and couples to the housing. The lamp and reflector are associated with the housing assembly whereby movement of the housing assembly allows relative movement of the lamp and the reflector to allow focusing of light from the lamp when an operator causes the actuator to move. According to the method of the invention, a flashlight is selectively focused by selectively sliding an actuator that is connected to a moveable lamp assembly having a lamp. The actuator is on the exterior surface of the flashlight body and is slid in a direction approximately parallel to a longitudinal axis of the flashlight body. In this manner the lamp housing assembly is selectively positioned relative to the reflector.

U.K. Number GB 2306000

Inventor: Shoei-Shuh Shieu

Issued: Apr. 23, 1997

A variable focusing flashlight includes a barrel. A tail cap is mounted for urging a battery towards the other end of the barrel. A lamp base retains a lamp and a head assembly is mounted on the other end of the barrel. The lamp base includes a stationary receptacle mounted to the barrel, firs and second conductors mounted in the stationary receptacle for connecting the terminals of the lamp to positive and negative terminals of the battery, and a movable receptacle mounted movably on the stationary receptacle. A conductive connector has an annular plate adjacent a bottom side, an upwardly extending plate projecting form the annular plate and sandwiched between the stationary receptacle and the barrel and a pointed protrusion extending from the upwardly extending plate to pierce an inner anodized coating of the barrel to connect electrically with the barrel.

U.K. Number GB 2309073

Inventor: Stephen A. Griffiths

Issued: Jul. 16, 1997

A portable battery operated electric lamp has a body, a reflector fixed with respect to the body and a fight source movable with respect to the reflector to adjust the focus of the lamp, an adjusting mechanism having a longitudinal movable slide for movement of the light source with respect to the reflector, whereby the beam produced by the light source may be adjusted from a pencil beam to a divergent beam.

While these variable beam flashlights may be suitable for the purposes for which they were designed, they would not be as suitable for the purposes of the present invention, as hereinafter described. It is thus desirable to provide a variable beam flashlight device that operates by means of one hand operation, specifically with the thumb of that hand, leaving one hand free. It is further desirable to provide an adjustable device that may be fit to any type of flashlight.

SUMMARY OF THE PRESENT INVENTION

The present invention overcomes the shortcomings of the prior art by providing a variable beam illumination device that may be operated with the use of one hand, that is useful to law enforcement, rescue worker and security enforcement.

A primary object of the present invention is to provide an illumination device, including but not limited to a flashlight, which has a variable width beam, regulated by a control knob that may be easily manipulated by a finger or thumb.

Another object of the present invention is to provide a flashlight beam that may be adjusted from a spot light beam to a flood light beam.

Still yet another object of the present invention is to provide a flashlight unit that has an variable beam width and may operate on the power of a variety of battery sizes.

Another object of the present invention is to provide an exterior control knob for adjusting the beam width, with the interior being protected from the elements.

Additional objects of the present invention will appear as the description proceeds.

The present invention is an illumination device having a selectively variable light beam, the preferred embodiment being in the form of a flashlight.

The present invention provides a variable beam width flashlight where the bulb is axially advanced among different positions with respect to the lens and a specially shaped reflector between the bulb and the lens. The bulb is advanced in response to a control knob protruding from the housing where it is displaced by the thumb in a direction perpendicular to the housing. The control knob rotates a guide housing that has a axially aligned slot. The guide housing is rotated within a bore with a helical groove positioned on the surface defining the bore. A bulb extension member is within the guide housing and has a groove member protruding through the guide housing slot and into the helical groove. The movement of the guide housing in response to the control knob causes the slot to force the groove member to track in the helical groove.

An illumination device is provided for utilizing a power source to power a bulb and shine a beam from the device, comprising: a housing having a cavity adapted to receive the power source, the housing having a front end, a longitudinal axis and a surface, the housing surface having a slot, and an aperture; a head assembly positioned on the housing front end, the head assembly having a lens and a reflector, the reflector having a rearwardly disposed aperture; a light assembly, positioned within the housing cavity, for positioning the bulb at or between a retracted and an extended position, said positions placing the bulb in spaced relationships with respect to the reflector such that the beam cast by the device is broader when the bulb is in the extended position, and narrower when the bulb is in the retracted position, the movement of the bulb being generally aligned with the housing longitudinal axis, the light assembly further comprising: a control knob; a lower member, in electronic communication with the power source, the lower member having an on-off switch, the switch being accessible and operable through the housing surface aperture; an upper member, attached to the lower member, the upper member having an inner surface defining a bore, the inner surface having a helical groove; a guide housing having a slot, the guide housing being closely received by the upper member bore, the control knob being attached to the guide housing and extending through the housing surface slot, such that movement of the control knob in the housing surface slot rotates the guide housing, the rotation being generally about the housing longitudinal axis; and a bulb extension member, in electronic communication with the bulb and in electronic communication with the power source through the lower member and the switch, the bulb extension member having a groove member and a receptacle for receiving the bulb, the guide housing closely receiving the bulb extension member such that the groove member extends through the guide housing slot and into the upper member helical groove, the rotation of the guide housing slot displacing the groove member as the guide housing is rotated by the control knob, the groove member following the upper member helical groove during said rotation, causing the bulb extension member to be displaced generally along the housing longitudinal axis, said displacement moving the bulb between the bulb extended and retracted positions, the displacement direction being determined by the direction in which the control knob is moved.

In another embodiment, the reflector further has a conical first portion and a cylindrical second portion, the second portion having the rearwardly disposed aperture.

In another embodiment, the reflector second portion has a substantially constant diameter, the second portion tapering rearwardly while maintaining the constant diameter.

In another embodiment, the reflector is generally parabolic.

In another embodiment, the housing and head assembly are generally configured as a flashlight.

In another embodiment, the device further comprises a ring positioned between the upper member and the lower member, the ring being positioned for rotation about the housing longitudinal axis, the ring having an aperture for receiving the control knob after it enters the housing slot and before the control knob is attached to the guide housing, the ring being adapted to cover the housing slot from within the housing.

There is provided an illumination device for utilizing a power source to power a bulb and shine a beam from the device, comprising: a housing having a cavity adapted to receive the power source, the housing having a front end, a longitudinal axis and a surface, the housing surface having a slot, and an aperture; a head assembly positioned on the housing front end, the head assembly having a lens and a reflector, the reflector having a rearwardly disposed aperture; a light assembly having means for positioning the bulb at or between a retracted and an extended position, said positions placing the bulb in spaced relationships with respect to the reflector such that the beam cast by the device is broader when the bulb is in the extended position, and narrower when the bulb is in the retracted position, the movement of the bulb being generally aligned with the housing longitudinal axis.

In another embodiment, the reflector further has a conical first portion and a cylindrical second portion, the second portion having the rearwardly disposed aperture.

In another embodiment, the reflector second portion has a substantially constant diameter, the second portion tapering rearwardly while maintaining the constant diameter.

In another embodiment, the reflector is generally parabolic.

In another embodiment, the housing and head assembly are generally configured as a flashlight.

A flashlight is provided for utilizing a power source to power a bulb and shine a beam from the flashlight, comprising: a housing having a cavity adapted to receive the power source, the housing having a front end, a longitudinal axis and a surface, the housing surface having a slot, and an aperture; a head assembly positioned on the housing front end, the head assembly having a lens and a reflector, the reflector having a conical first portion and a cylindrical second portion, the second portion having a substantially constant diameter rearwardly disposed aperture, the second portion being tapered rearwardly while maintaining the constant diameter; a light assembly, positioned within the housing cavity, for positioning the bulb at or between a retracted and an extended position, said positions placing the bulb in spaced relationships with respect to the reflector such that the beam cast by the flashlight is broader when the bulb is in the extended position, and narrower when the bulb is in the retracted position, the movement of the bulb being generally aligned with the housing longitudinal axis, the light assembly further comprising: a control knob; a lower member, in electronic communication with the power source, the lower member having an on-off switch for initiating and terminating the electronic communication, the switch being accessible and operable through the housing surface aperture; an upper member, attached to the lower member, the upper member having an inner surface defining a bore, the inner surface having a helical groove; a ring supported between the upper member and the lower member, the ring being supported for rotation; a guide housing having a slot, the guide housing being closely received by the upper member bore, the control knob being attached to the guide housing and extending through the ring and the housing surface slot, such that movement of the control knob in the housing surface slot rotates the guide housing, the rotation being generally about the housing longitudinal axis; and bulb extension member, in electronic communication with the bulb and in electronic communication with the power source through the lower member and the switch, the bulb extension member having a groove member and a receptacle for receiving the bulb, the guide housing closely receiving the bulb extension member such that the groove member extends through the guide housing slot and into the upper member helical groove, the rotation of the guide housing slot displacing the groove member as the guide housing is rotated by the control knob, the groove member following the upper member helical groove during said rotation, causing the bulb extension member to be displaced generally along the housing longitudinal axis, said displacement moving the bulb between the bulb extended and retracted positions, the displacement direction being determined by the direction in which the control knob is moved.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is an illustrative view of the present invention in use. Shown above is an illustrative view of the variable beam illumination assembly of the present invention.

FIG. 2 is an illustrative view of the present invention in use. The variable beam control knob adjusts the unit from a spot light beam to a flood light beam as required by the user, FIG. 3 is an illustrative view of the present invention in use. Shown is the user's thumb manipulating the control knob.

Figure 5:
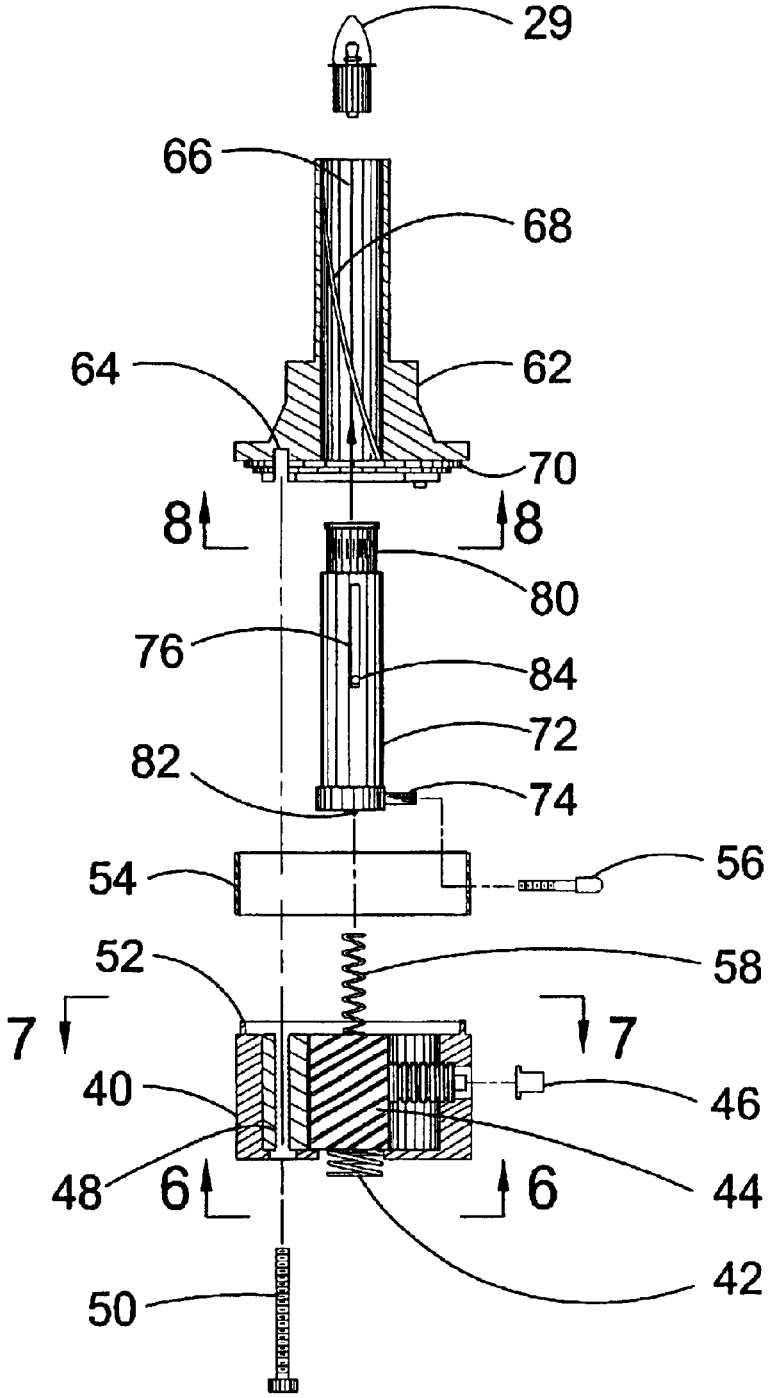

FIG. 5 is an exploded, partial sectional view of the variable beam flashlight of the present invention. The upper casing member has a helical groove that mates with a groove member protruding from the bulb extension member. The bulb extension telescopes within the guide housing which is, in turn, rotated by the control knob The upper casing member has been rotated 180 degrees in this figure to better show the helical groove.

Figure 6:
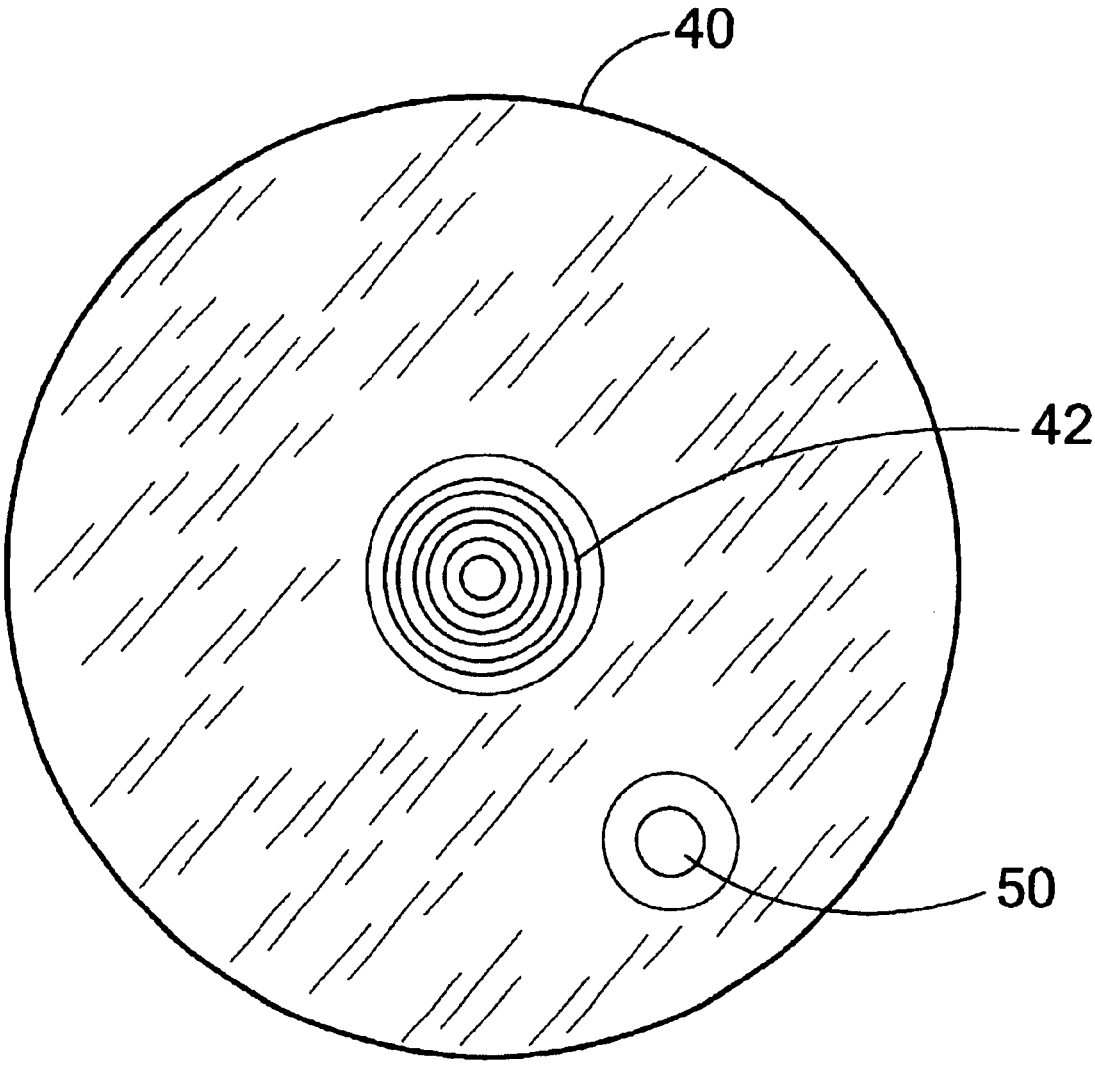

FIG. 6 is a bottom view of the lower casing member of the variable beam flashlight.

Figure 7:
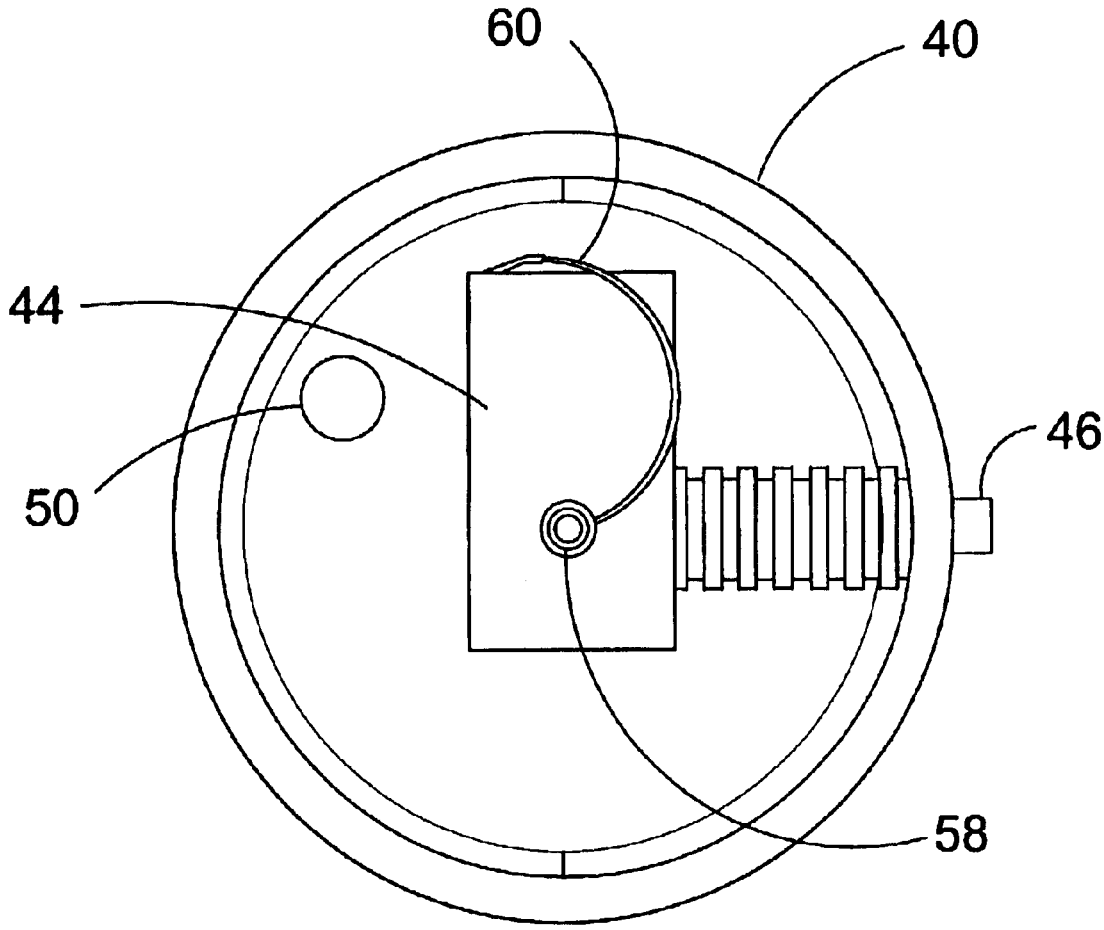

FIG. 7 is a top view of the lower casing member showing the on/off switch and switch button recessed within the casing and a contact spring above the switch housing.

Figure 8:
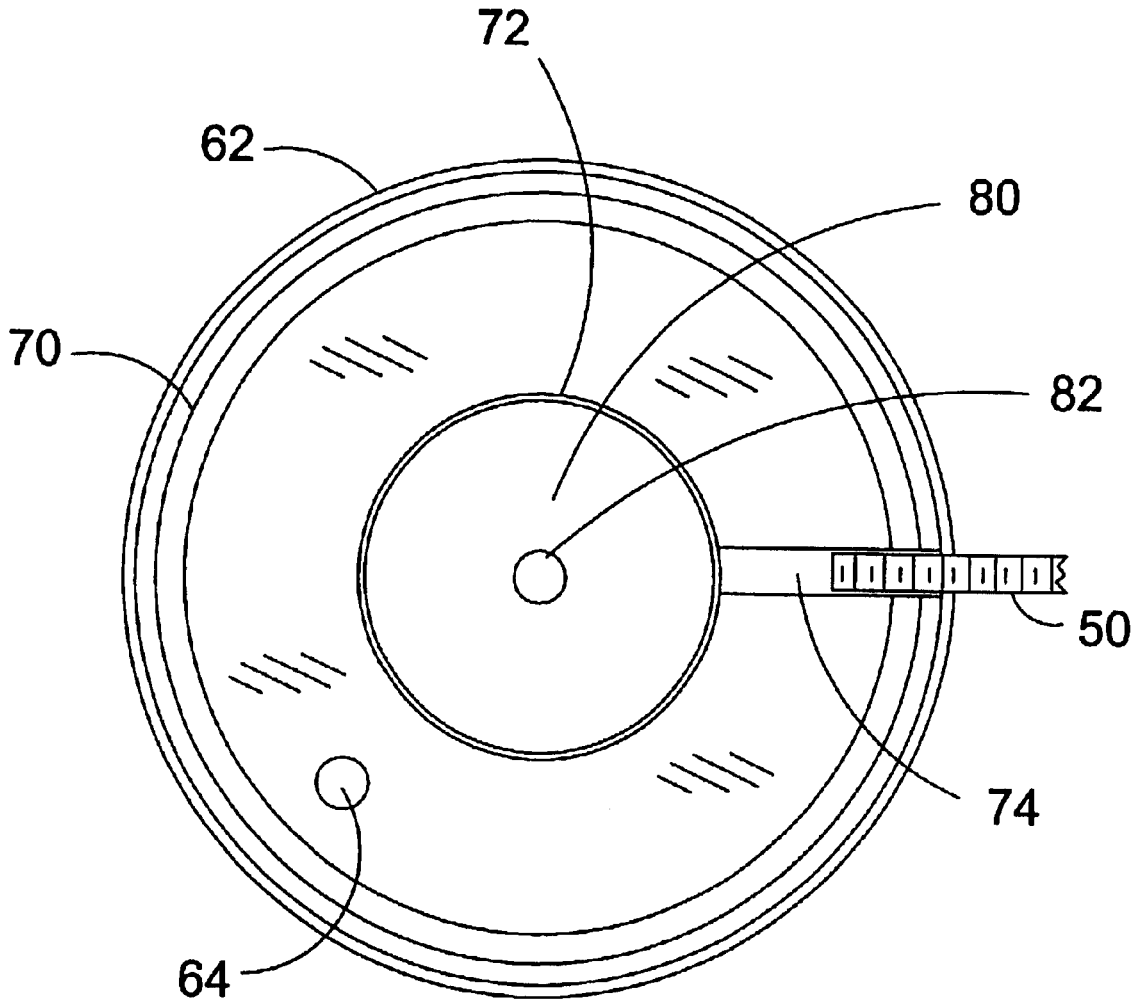

FIG. 8 is a bottom view of the upper casing member showing guide housing and the bulb extension member housed within. Also shown is the threaded light beam control knob post which is part of the lamp guide housing and receives threaded control knob, which controls the movement of the guide housing and bulb extension member. Also shown is a threaded port whereby a retaining screw is inserted and screwed in from the lower casing member, thus attaching both lower and upper casing members together.

Figure 9:
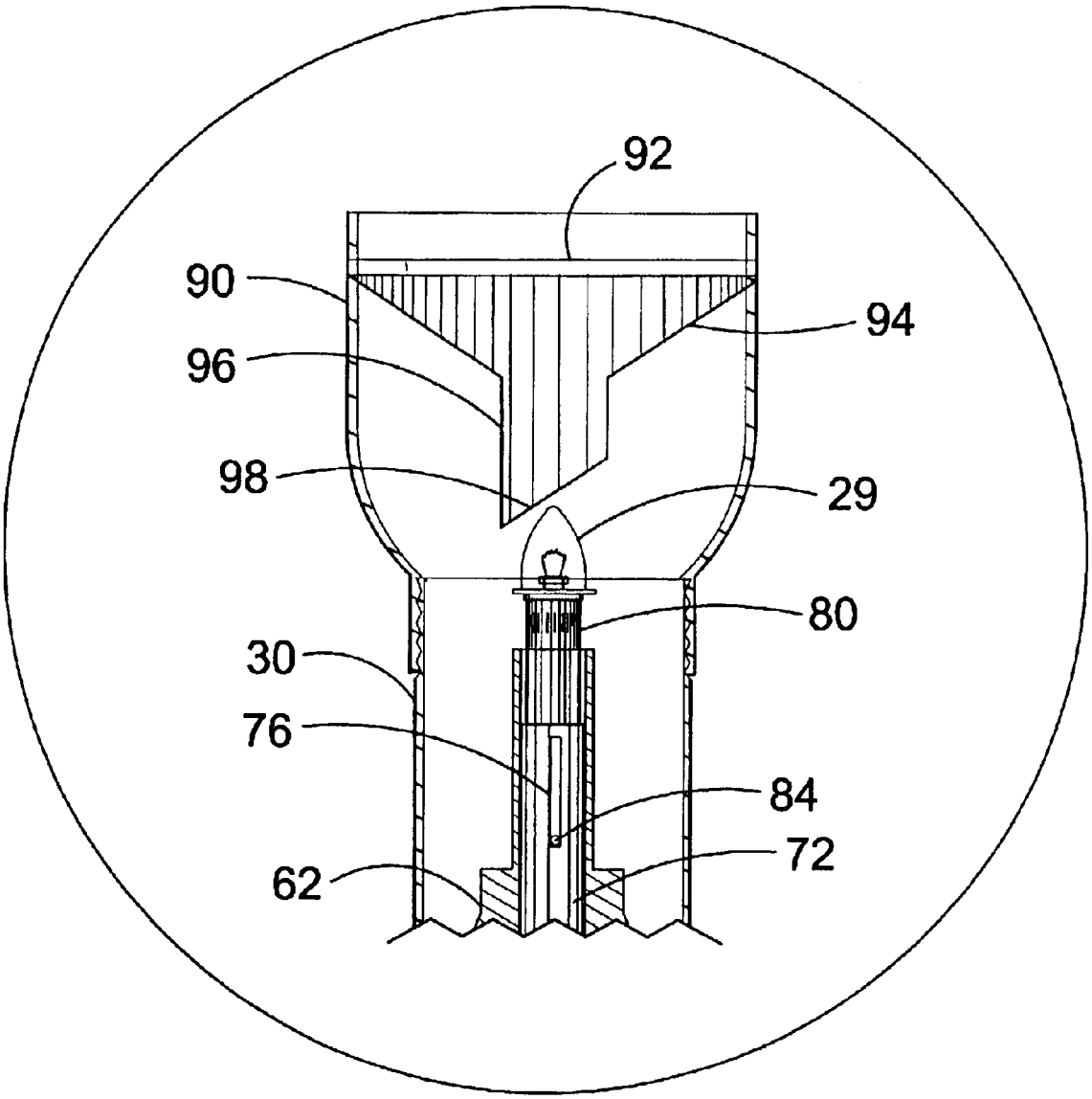

FIG. 9 is a partial sectional view of the variable beam flashlight with the bulb in the fully retracted position. When the beam control knob is to the extreme left position, the bulb and the bulb extension member are fully retracted within the guide housing.

Figure 10:
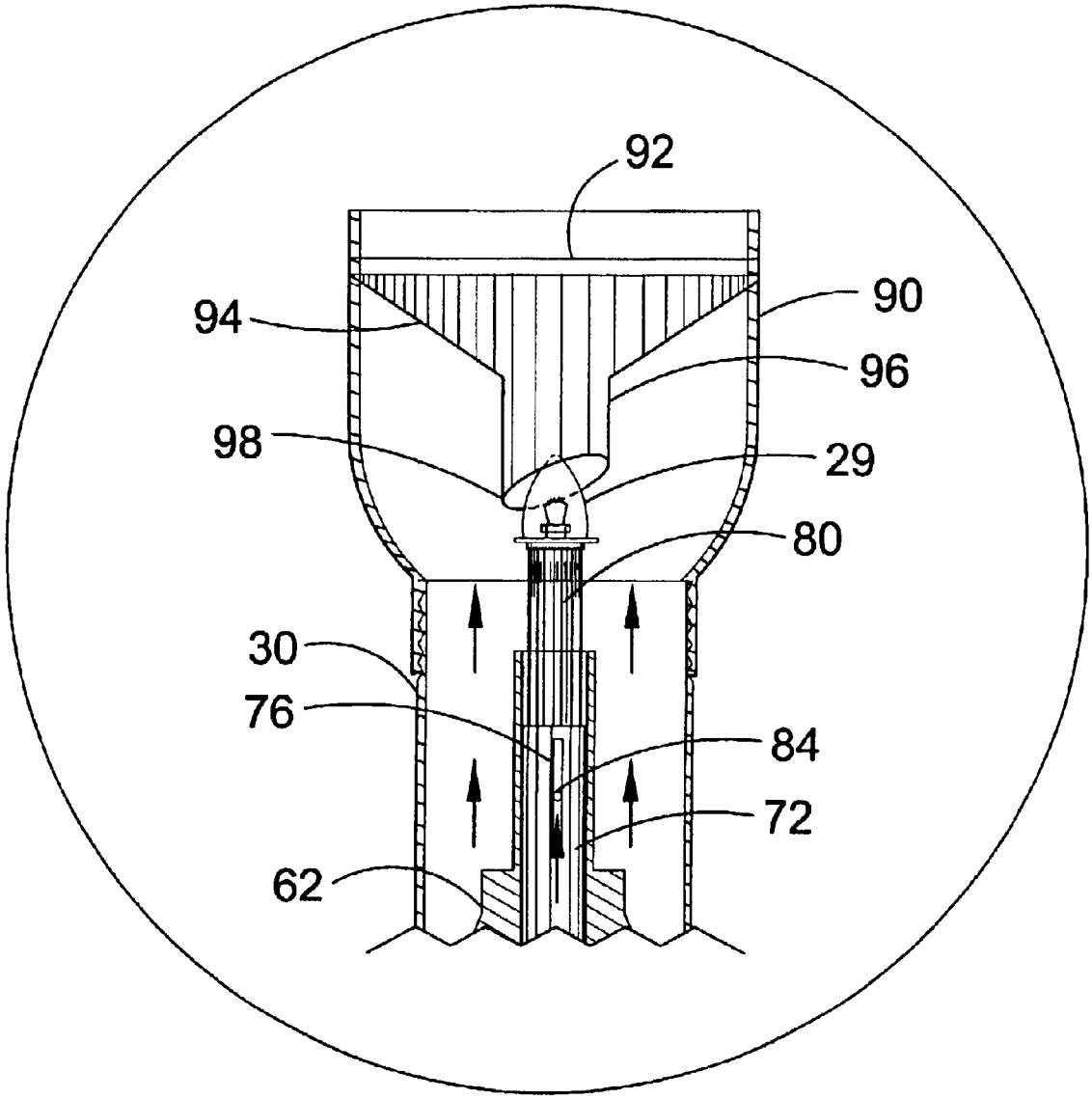

FIG. 10 is a partial sectional view, rotated 45 degrees from FIG. 9, of the variable beam flashlight with the bulb in the partially extended position. When the control knob is moved to the center position, the bulb is between the fully retracted and filly extended position.

Figure 11:
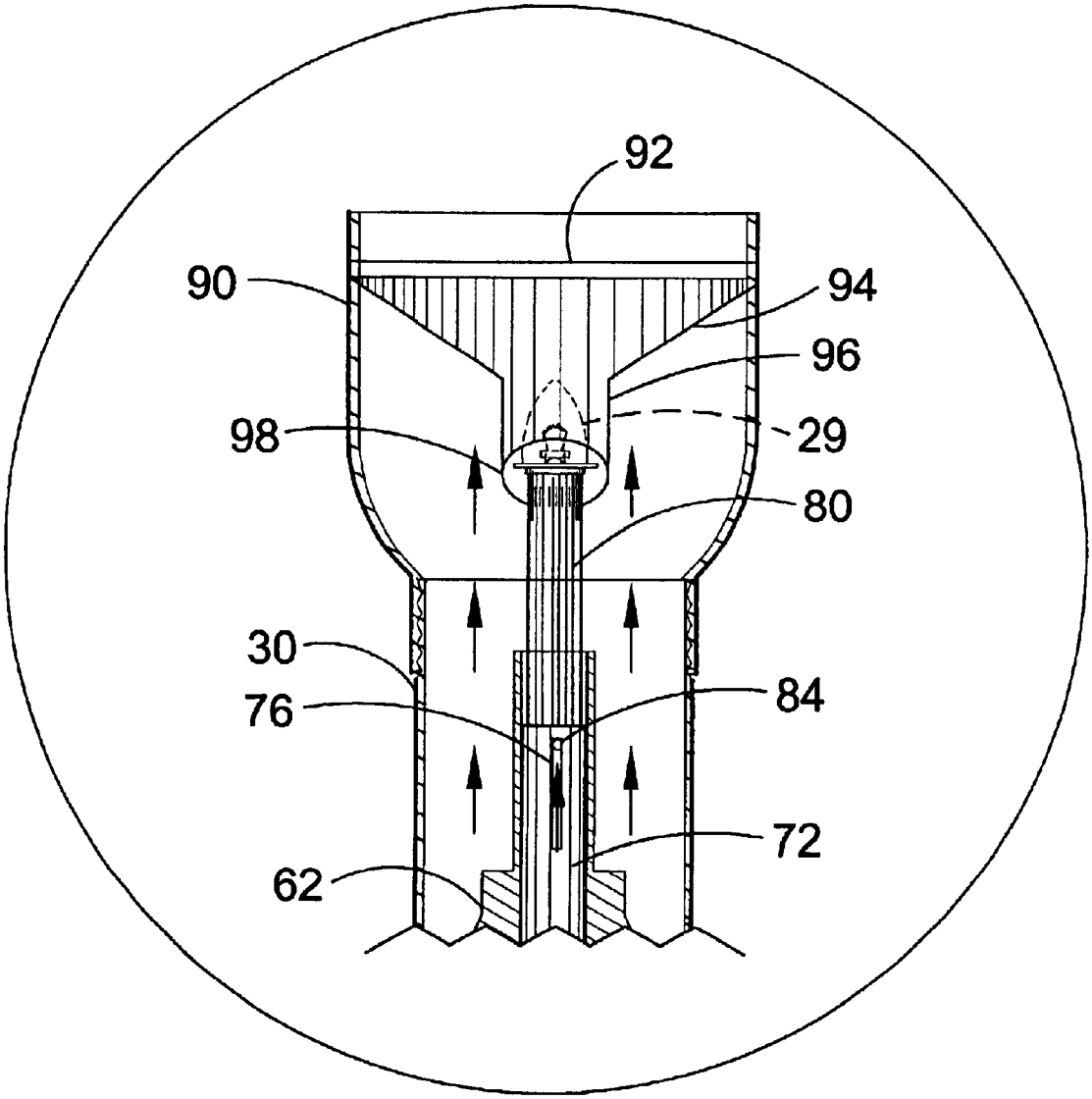

FIG. 11 is a partial sectional view of the variable beam flashlight, rotated 45 degrees from FIG. 10 and 90 degrees from FIG. 11 in the fully extended position. When the control knob is moved to the right position, the bulb and the bulb extension member are fully extended within the guide housing, and the bulb is in the extended position.

DESCRIPTION OF THE REFERENCED NUMERALS

Turning now descriptively to the drawings, in which similar reference characters denote similar elements throughout the several views, the figures illustrate the variable beam flashlight of the present invention. With regard to the reference numerals used, the following numbering is used throughout the various drawing figures.

20 variable beam flashlight of the present invention
22 user
23 user hand
24 user thumb
26 floodlight beam
28 spot light beam
30 housing
32 housing end cap
34 spring contact
36 housing slot
38 housing hole
40 lower casing assembly body
42 battery contact spring
44 on-off switch
46 on-off switch button
48 retaining screw hole
50 retaining screw
52 circular extension
54 ring
56 control knob
58 spring contact
60 spring contact wiring
62 upper casing body
64 retaining screw threaded hole
66 upper casing body bore
68 helical groove
70 shoulder
72 guide housing
74 guide housing extension
76 guide housing slot
80 bulb extension member
82 contact
84 groove member
90 head
92 lens
94 reflector conical portion
96 reflector cylindrical portion
98 reflector cylindrical portion taper

DETAILED DESCRIPTION OF THE PREFERRED EMBODIMENTS

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
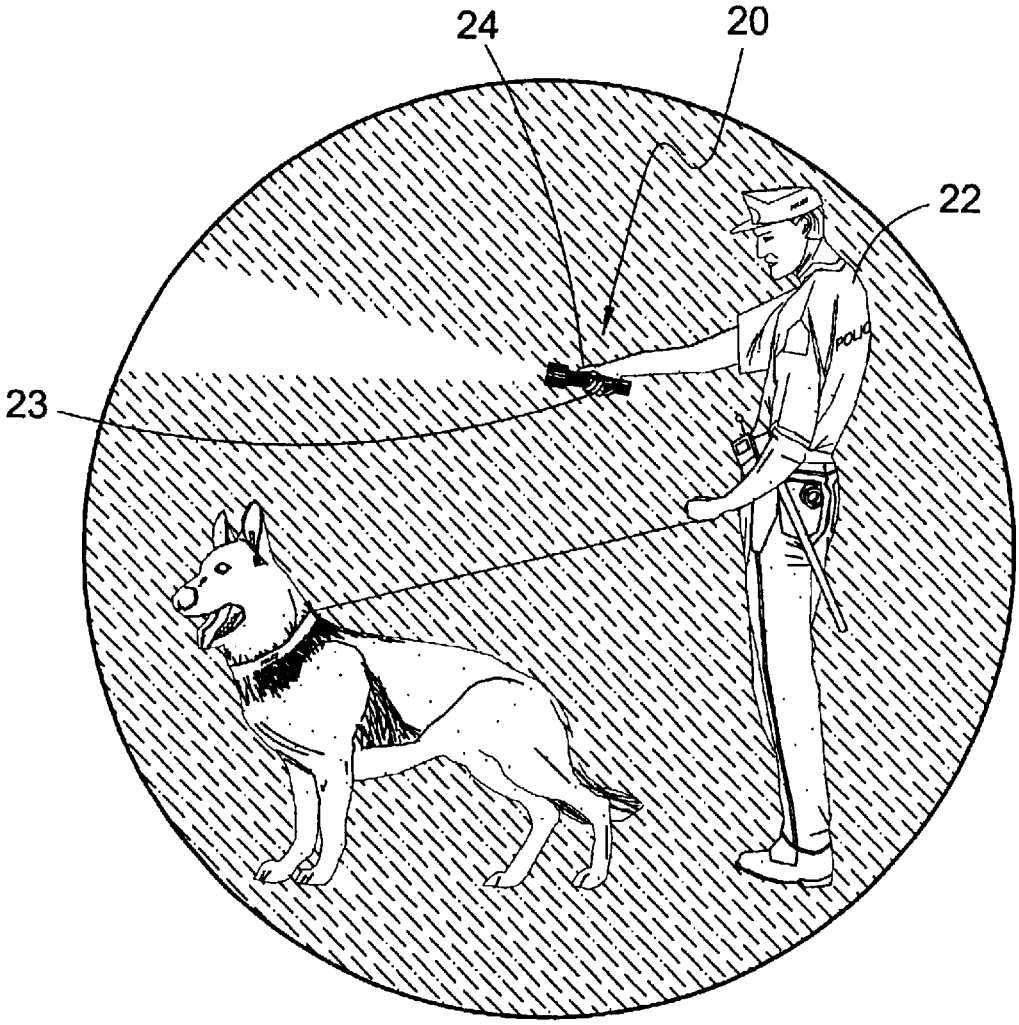
Figure 2:
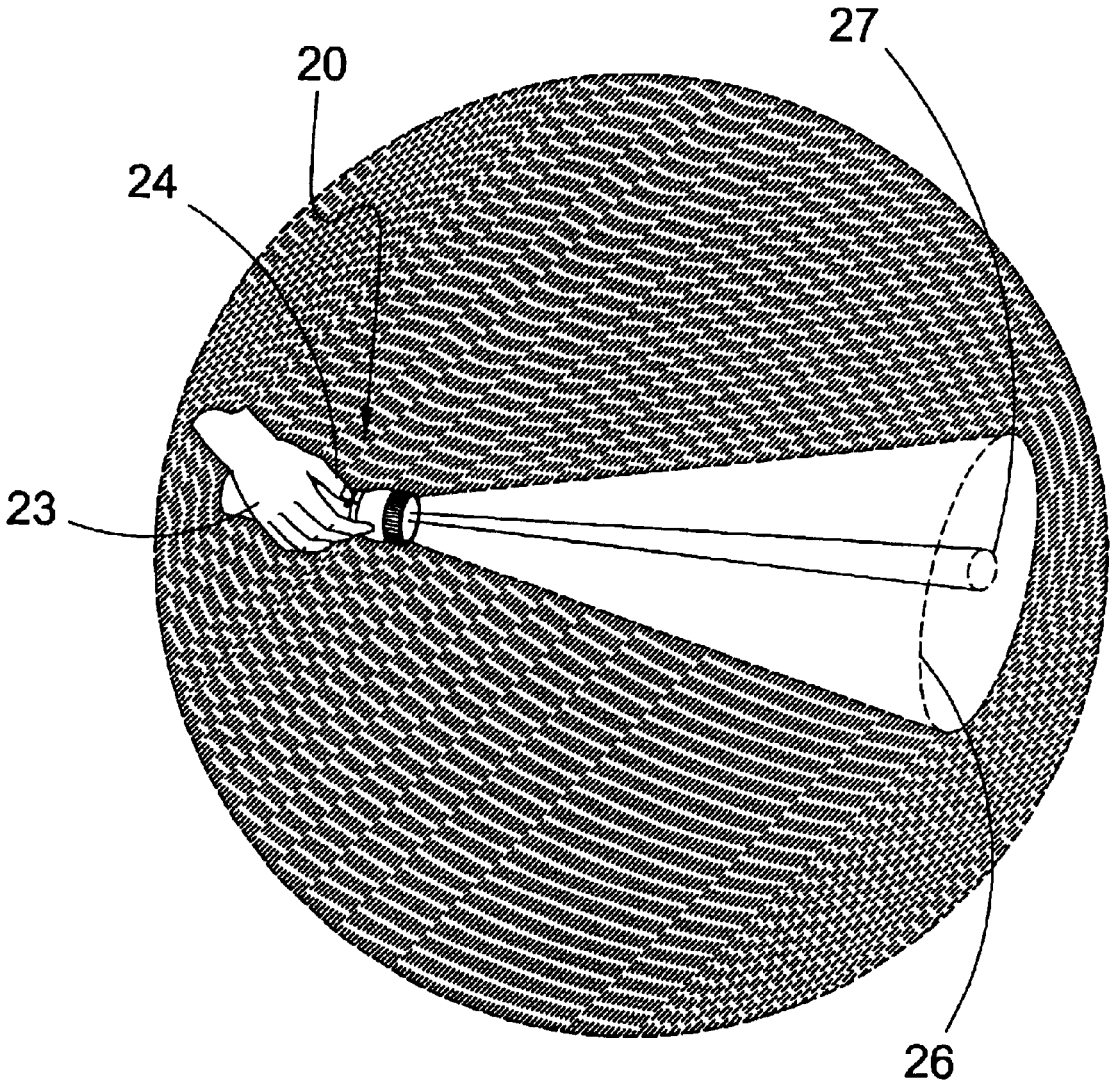
Figure 3:
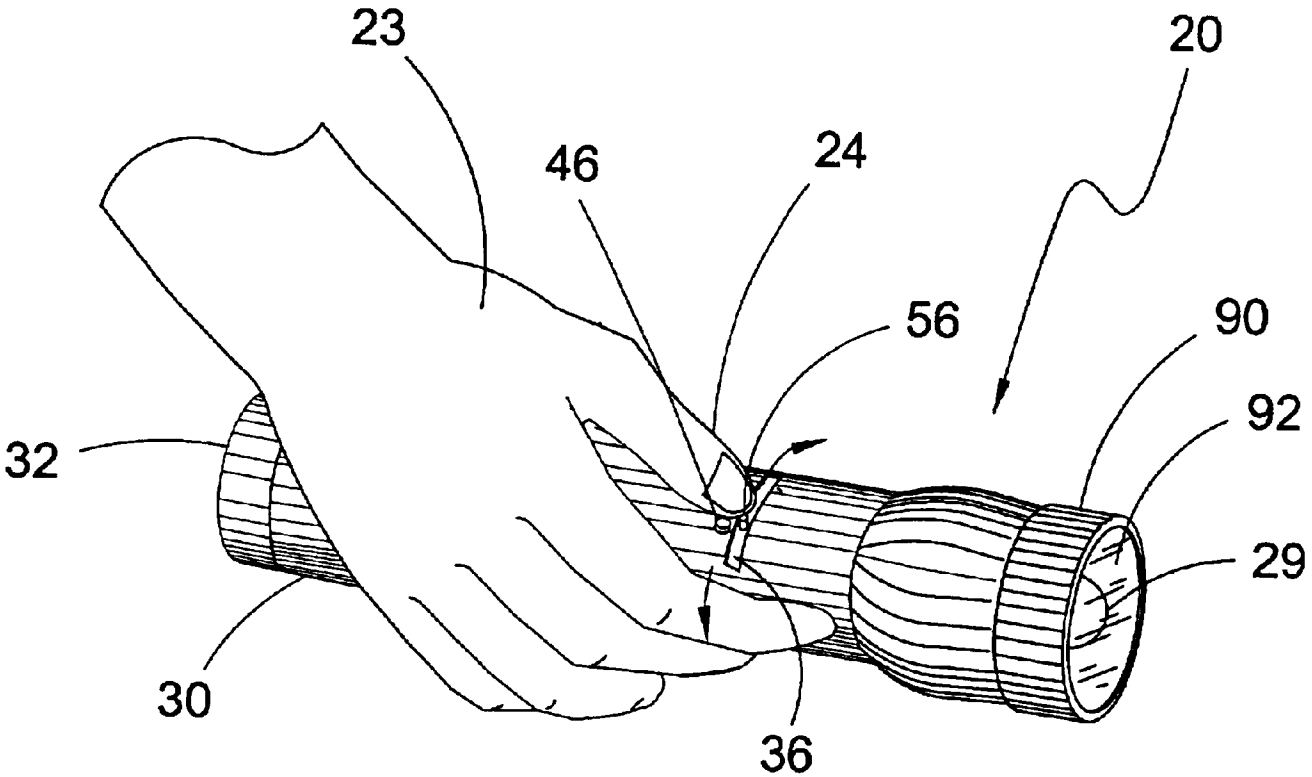
Figure 4:
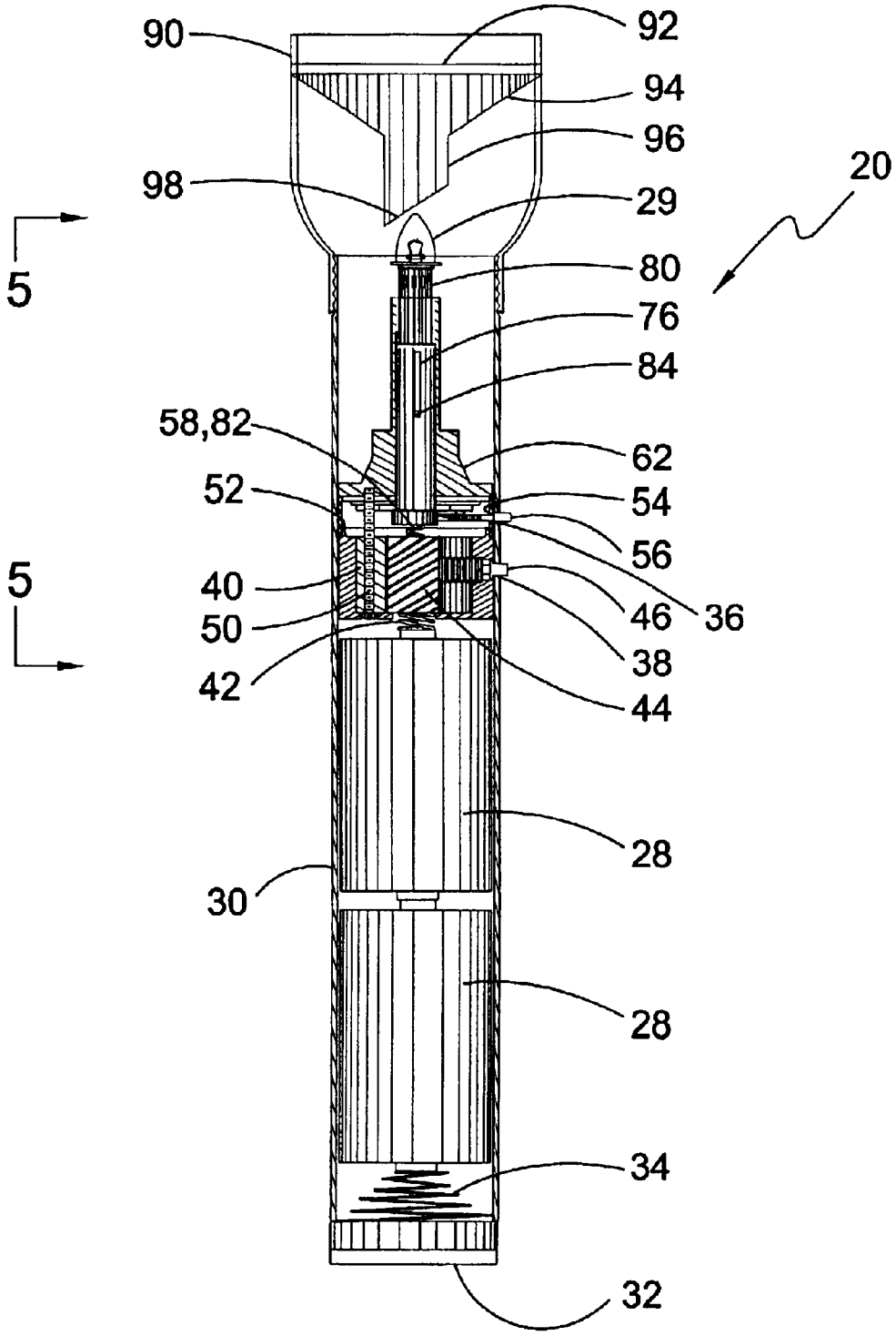
FIG. 4 is a partial sectional view of the variable beam flashlight of the present invention. The guide housing is not sectioned.
Figure 4A:
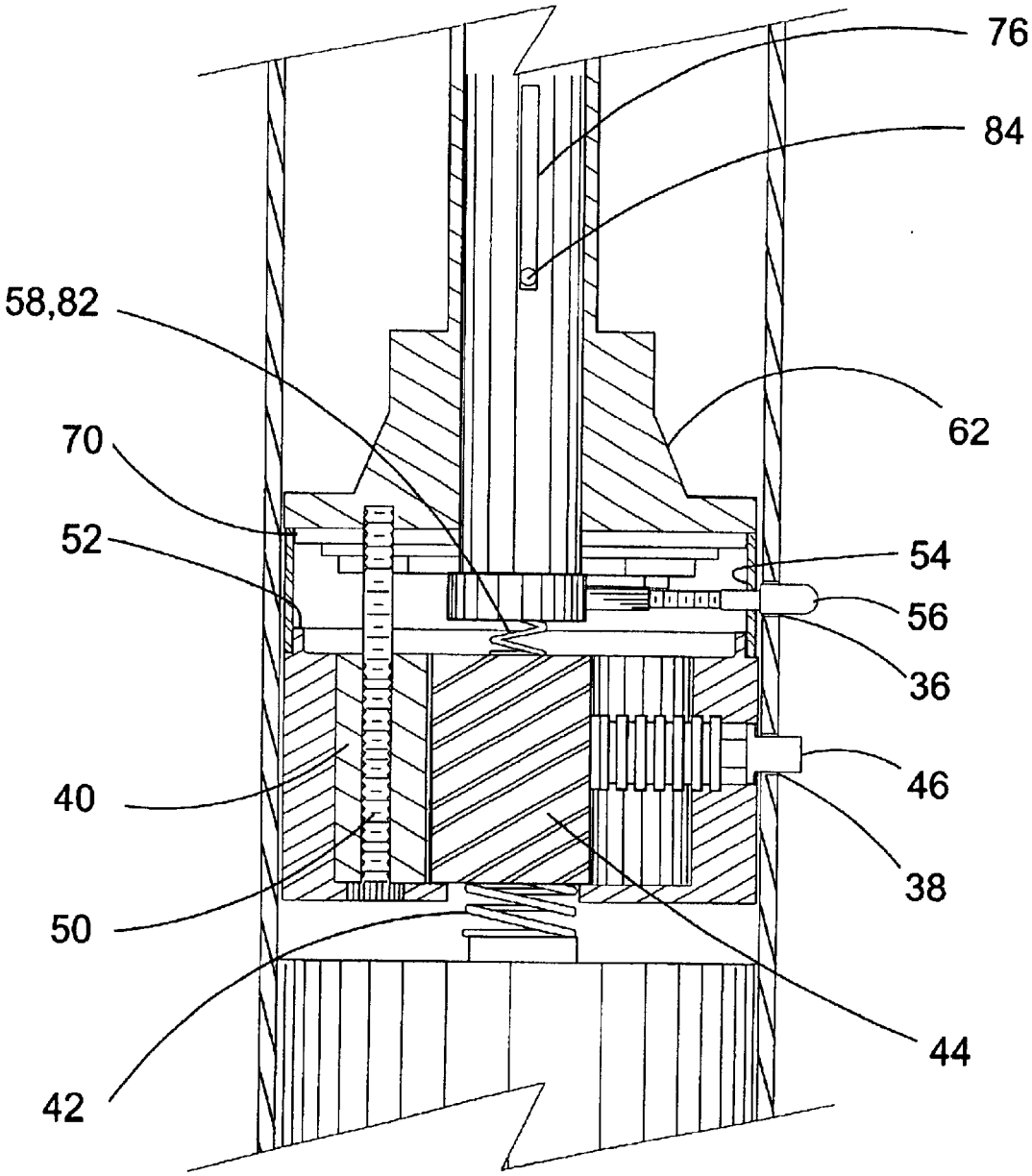
FIG. 4A is an enlarged portion taken from FIG. 4.

FIGS. 1–11 depict the preferred embodiment of the variable beam illumination device 20, with FIG. 1 depicting the flashlight embodiment 20 in use by a person 22 holding the device 20 in his hand 23 with his thumb 24 on top. FIG. 2 depicts the wider flood light beam 26 and the narrower spot light beam 27. FIG. 4 depicts the conventional batteries 28 and bulb 29 that are used in the device 20.

FIG. 3 depicts the housing 30 and the end cap 32 that is threadably coupled onto the housing 30 after batteries 28 are inserted. A spring contact 34 is attached to the end cap and bears upon the lower battery 28, as shown in FIG. 4. FIG. 3 also depicts a housing slot 36, and FIG. 4 depicts a housing hole 38.

The spring contact 34 biases the batteries 28 against a lower casing assembly having a body 40 conformed to the inner perimeter of the housing 30. On the body 40 is a battery contact spring 42 for establishing electronic communication between the batteries 29 and a conventional on-off switch 44. As shown in FIGS. 3–5, and particularly in FIG. 7, the switch 44 has a button 46 protruding through the housing hole 38 to make the working of the switch 44 easily available to the user's thumb 24. The body 40 also has a hole 48 for receiving a retaining screw 50, as shown particularly in FIGS. 5–6.

On top of the body 40 is a circular extension 52 that rotationally positions a dust cover ring 54 on the top of the body 40. The ring 54 also has an aperture for allowing passage of the control knob 56. The ring 54 has sufficient width and diameter to effectively seal the housing slot 36.

Also on top of the body 40 is a spring contact 58, as shown in FIG. 7 that is in electronic communication with the switch 44 through wiring 60.

The lower casing body 40 is attached to an upper casing body 62 using the retaining screw 48 in a threaded hole 64, as shown in FIG. 5 and FIG. 8. As further shown in FIG. 5, the upper casing body 62 has a cylindrical bore 66, with a helical groove 68 along the inner perimeter of the bore 66. An upper casing body shoulder 70, corresponding with the lower casing body circular extension 52, extends downwardly from the upper casing body 62, thus completing the support for the rotation of the ring 54. When the upper casing body 62 is attached to the lower casing body 40, the ring 54 is sandwiched between the two and is free to rotate about the longitudinal axis of the housing 30, in response to the movement of the control knob 56 as the control knob 56 is moved sideways by the user's thumb 24.

As shown in FIGS. 4–5 and FIG. 8, a guide housing 72 is positioned within the upper casing body bore 66. A guide housing extension 74 is threaded for coupling with the control knob 54 that has passed through the housing slot 36 and ring 54 aperture. As the ring 54 rotates, the guide housing 72 rotates as well. The guide housing 72 also has a slot 76, lying parallel to the longitudinal axis of the housing 30.

Slidably positioned within the guide housing 72 is a bulb extension member 80 having on its bottom a contact member 82 for electronic communication with the spring contact 58 on the lower casing body 40. As shown in FIG. 5, the bulb extension member 80 has a small groove member 84 that protrudes from the bulb extension member 80, through the guide housing slot 76, and then into the helical groove 68 in the upper casing body 62. (The upper casing body 68 is rotated 180 degrees in FIG. 5 in order to show both the groove member 84 and the helical groove 68 simultaneously.

The guide housing slot 76 prevents rotation of the bulb extension member 80 relative to the guide housing 72, however, the bulb extension member 80 rotates with the guide housing 72. Because the groove member 84 is also in the helical groove 68, such rotation forces the groove member 84 to track up or down in the helical groove 68 depending on the direction in which the guide housing 72 is rotated in response to movement of the control knob 56. As the groove member 84 tracks up the helical groove 68, the bulb extension member 80 is forced to move upwardly with respect to the guide housing 72. Similarly, as the groove member 84 tracks down the helical groove 68, the bulb extension member 89 is forced to move downwardly with respect to the guide housing 72.

The bulb 29 is positioned in the bulb extension member 80, and is in electronic communication with the electrical contact member 82, and in extendable electronic communication with the switch 44, by virtue of the expansion of the spring contact 58 to retain contact with the electrical contact member 82 as the bulb extension member 80 moves upwardly. Accordingly, when the switch 44 is on the bulb 29 will be in electronic communication with the batteries 28 and powered by the same.

FIGS. 3–4 depict the flashlight head 90 that is threadably coupled to the open end of the housing 30. The head 90 positions a generally planar lens 92 above a reflector conical portion 94, which decreases in diameter to a reflector cylindrical portion 96, having a substantially constant diameter. The reflector cylindrical portion 96 extends through a tapered portion 98, formed on the cylindrical portion 96 as if a plane cut the cylinder non-perpendicularly, leaving the cylindrical diameter constant.

In the fully retracted, lowermost position, the bulb extension member 80 positions the bulb 29 proximate the reflector tapered portion 98, as depicted in FIG. 9. In this retracted position, the bulb's light is initially constricted to the reflector cylindrical portion 96, thus focusing the light into the spot light beam 27.

In the fully extended position, the bulb extension member 80 has telescoped from the guide housing 72 and positioned the bulb 29 proximate the reflector conical portion 94, as depicted in FIG. 11. In this extended position, the bulb's light is readily dispersed by the reflector conical portion 96, thus expanding the light into the flood light beam 26.

As shown in FIG. 10, intermediate positions of the control knob 56 will position the bulb 29 such that beams of widths between full flood and spot light will result.

With respect to the above description then, it is to be realized that the optimum material and dimensional relationships for the parts of the illuminating flashlight 20, will include variations in size, materials, shape, and form, which will occur to those skilled in the art upon review of the present disclosure. For example, conventional insulator and conductor materials will be included to achieve the proper relationship of the electrical circuit components described above, as necessary to power the bulb 29 using the batteries 28. The ability to maintain electrical contact between a moving bulb receptacle and the remaining electrical components has been demonstrated in patents issued to Anthony Maglica (U.S. Pat. No. 4,388,673), Gary W. Kibler (U.S. Pat. No. 5,826,971), Shoei-Shuh Shiau (U.S. Pat. No. 4,967,325) and Ricky W. Tillery (U.S. Pat. No. 5,461,552), which are incorporated herein by reference for all purposes. A parabolic reflector can be substituted for the reflector conical portion 94 or for the entire reflector. A push-button on-off switch 44 is used in the preferred embodiment, however, other conventional switches, such as sliding switches can also be readily adapted for use with the present invention. Similarly, various types of batteries, including rechargeable batteries, can be used. Adaptation to auxiliary power source outlets on automobiles, and the like, can also bed readily incorporated for use with the present invention. Typical materials for the construction of the flashlight 20 will include various metals, plastics and glasses.

All equivalent relationships to those illustrated in the drawings and described in the specification are intended to be encompassed by the present invention.

What is claimed as new and desired to be protected by Letters Patent is set forth in the appended claims:

1. An illumination device for utilizing a power source to power a bulb and shine a beam from the device, comprising:

a housing having a cavity adapted to receive the power source, the housing having a font end, a longitudinal axis and a surface, the housing surface having a slot, and an aperture;

a head assembly positioned on the housing front end, the head assembly having a lens and a reflector, the reflector having a rearwardly disposed aperture;

a light assembly, positioned within the housing cavity, for positioning the bulb at or between a retracted and an extended position, said positions placing the bulb in spaced relationships with respect to the reflector such that the beam cast by the device is broader when the bulb is in the extended position, and narrower when the bulb is in the retracted position, the movement of the bulb being generally aligned with the housing longitudinal axis, the light assembly further comprising:

a control knob;

a lower member, in electronic communication with the power source, the lower member having an on-off switch, the switch being accessible and operable through the housing surface aperture;

an upper member, attached to the lower member, the upper member having an inner surface defining a bore, the inner surface having a helical groove;

a guide housing having a slot, the guide housing being closely received by the upper member bore, the control knob being attached to the guide housing and extending through the housing surface slot, such that movement of the control knob in the housing surface slot rotates the guide housing, the rotation being generally about the housing longitudinal axis; and a bulb extension member, in electronic communication with the bulb and in electronic communication with the power source through the lower member and the switch, the bulb extension member having a groove member and a receptacle for receiving the bulb, the guide housing closely receiving the bulb extension member such that the groove member extends through the guide housing slot and into the upper member helical groove, the rotation of the guide housing slot displacing the groove member as the guide housing is rotated by the control knob, the groove member following the upper member helical groove during said rotation, causing the bulb extension member to be displaced generally along the housing longitudinal axis, said displacement moving the bulb between the bulb extended and retracted positions, the displacement direction being determined by the direction in which the control knob is moved.

2. The illumination device of claim 1, wherein the reflector further has a conical first portion and a cylindrical second portion, the second position having the rearwardly disposed aperture.

3. The illumination device of claim 2, wherein the reflector second portion has a substantially constant diameter, the second portion tapering rearwardly while maintaining the constant diameter.

4. The illumination device of claim 1, wherein the reflector is generally parabolic.

5. The illumination device of claim 1, wherein the housing and head assembly are generally configured as a flashlight.

6. The illumination device of claim 1, wherein the device further comprises a ring positioned between the upper member and the lower member, the ring being positioned for rotation about the housing longitudinal axis, the ring having an aperture for receiving the control knob after it enters the housing slot and before the control knob is attached to the guide housing, the ring being adapted to cover the housing slot from within the housing.

7. A flashlight for utilizing a power source to power a bulb and shine a beam from the flashlight, comprising:

a housing having a cavity adapted to receive the power source, the housing having a front end, a longitudinal axis and a surface, the housing surface having a slot, and an aperture;

a head assembly positioned on the housing front end, the head assembly having a lens and a reflector, the reflector having a conical first portion and a cylindrical second portion, the second portion having a substantially constant diameter rearwardly disposed aperture, the second portion being tapered rearwardly while maintaining the constant diameter;

a light assembly, positioned within the housing cavity, for positioning the bulb at or between a retracted and an extended position, said positions placing the bulb in spaced relationships with respect to the reflector such that the beam cast by the flight is broader when the bulb is in the extended position, and narrower when the bulb is in the retracted position, the movement of the bulb being generally aligned with the housing longitudinal axis, the light assembly further comprising:

a control knob;

a lower member, in electronic communication with the power source, the lower member having an on-off switch for initiating and terminating the electronic communication, the switch being accessible and operable through the housing surface aperture; an upper member, attached to the lower member, the upper member having an inner surface defining a bore, the inner surface having a helical groove;

a ring supported between the upper member and the lower member, the ring being supported for rotation;

a guide housing having a slot, the guide housing being closely received by the upper member bore, the control knob being attached to the guide housing and extending through the ring and the housing surface slot, such that movement of the control knob in the housing surface slot rotates the guide housing, the rotation being generally about the housing longitudinal axis; and a bulb extension member, in electronic communication with the bulb and in electric communication with the power source through the lower member and the switch, the bulb extension member having a groove member and a receptacle for receiving the bulb, the guide housing closely receiving the bulb extension member such that the groove member extends through the guide housing slot and into the upper member helical groove, the rotation of the guide housing slot displacing the groove member as the guide housing is rotated by the control knob, the groove member following the upper member helical groove during said rotation, causing the bulb non member to be displaced generally along the housing longitudinal axis, said displacement moving the bulb between the bulb extended and retracted positions, the displacement direction being determined by the direction in which the control knob is moved.

* * * * *